US006062958A

United States Patent [19]

Wright et al.

[11] Patent Number: 6,062,958

[45] Date of Patent: May 16, 2000

[54] VARIABLE ABRASIVE POLISHING PAD FOR MECHANICAL AND CHEMICAL-MECHANICAL PLANARIZATION

[75] Inventors: David Q. Wright; John K. Skrovan, both of Boise, Id.

[73] Assignee: Micron Technology, Inc., Boise, Id.

[21] Appl. No.: 08/834,524

[22] Filed: Apr. 4, 1997

[51] Int. Cl.[7] ..... B24B 5/00; B24B 29/00

[52] U.S. Cl. ..... 451/288; 451/41

[58] Field of Search ..... 451/41, 57, 285, 451/286, 287, 288, 526, 527, 529, 530, 531, 539; 15/230, 230.16

[56] References Cited

U.S. PATENT DOCUMENTS

| | | | |
|---|---|---|---|
| 1,139,817 | 5/1915 | Smith | 451/461 |
| 2,242,877 | 5/1941 | Albertson | 451/527 |
| 2,309,016 | 1/1943 | Ryan | 451/461 |
| 2,451,295 | 10/1948 | Metzger et al. | 451/461 |
| 2,496,352 | 2/1950 | Metzger et al. | 451/461 |
| 3,498,010 | 3/1970 | Hagihara | 451/527 |
| 3,617,347 | 11/1971 | Kuratomi | 117/69 |
| 3,841,031 | 10/1974 | Walsh | 51/283 |
| 4,111,666 | 9/1978 | Kalbow | 451/527 |
| 4,347,689 | 9/1982 | Hammond | 451/307 |
| 4,514,937 | 5/1985 | Gehrung et al. | 451/307 |
| 4,565,771 | 1/1986 | Lynch et al. | 430/307 |
| 4,576,612 | 3/1986 | Shukla et al. | 51/295 |
| 4,656,790 | 4/1987 | Mukai et al. | 451/307 |
| 4,736,475 | 4/1988 | Ekhoff | 451/307 |
| 5,012,618 | 5/1991 | Price et al. | 451/307 |
| 5,020,283 | 6/1991 | Tuttle | 51/209 |
| 5,127,196 | 7/1992 | Morimoto et al. | 51/165.73 |
| 5,177,908 | 1/1993 | Tuttle | 51/283 |
| 5,197,999 | 3/1993 | Thomas | 51/298 |
| 5,213,588 | 5/1993 | Wong et al. | 51/293 |
| 5,232,875 | 8/1993 | Tuttle et al. | 437/225 |
| 5,250,085 | 10/1993 | Mevissen | 51/298 |
| 5,297,364 | 3/1994 | Tuttle | 51/209 |
| 5,433,650 | 7/1995 | Winebarger | 451/6 |
| 5,435,772 | 7/1995 | Yu | 451/287 |
| 5,454,751 | 10/1995 | Wiang | 451/526 |
| 5,503,592 | 4/1996 | Neumann | 451/278 |
| 5,534,106 | 7/1996 | Cote et al. | 451/287 |
| 5,624,303 | 4/1997 | Robinson | 451/285 |
| 5,645,471 | 7/1997 | Strecker | 451/59 |

*Primary Examiner*—Derris Holt Banks
*Attorney, Agent, or Firm*—Dorsey & Whitney LLP

[57] ABSTRACT

An abrasive polishing pad for planarizing a substrate. In one embodiment, the abrasive polishing pad has a planarizing surface with a first planarizing region and a second planarizing region. The first planarizing region has a first abrasiveness and the second planarizing region has a second abrasiveness different than the first abrasiveness of the first region. The polishing pad preferably has a plurality of abrasive elements at the planarizing surface in at least one of the first or second planarizing regions. The abrasive elements may be abrasive particles fixedly suspended in a suspension medium, contact/non-contact regions on the pad, or other elements that mechanically remove material from the wafer. In operation of a preferred embodiment, the lesser abrasive of the first and second planarizing regions contacts a first area of the wafer where the relative velocity between the wafer and the polishing pad is relatively high, and the more abrasive of the first and second planarizing regions contacts a second area of the wafer where the relative velocity between the wafer and the polishing pad is relatively low. The different abrasivenesses of the first and second planarizing regions compensate for variations in relative velocities across the face of the wafer to more uniformly planarize the wafer.

2 Claims, 4 Drawing Sheets

VARIABLE ABRASIVE POLISHING PAD FOR MECHANICAL AND CHEMICAL-MECHANICAL PLANARIZATION

TECHNICAL FIELD

The present invention relates to polishing pads used in mechanical and/or chemical-mechanical planarization of substrates, and more particularly to a polishing pad with an abrasive planarizing surface.

BACKGROUND OF THE INVENTION

Chemical-mechanical planarization ("CMP") processes remove material from the surface of semiconductor wafers or other substrates in the production of integrated circuits. FIG. 1 schematically illustrates a CMP machine 10 with a platen 20, a wafer carrier 30, and a polishing pad 40. The polishing pad 40 may be a conventional polishing pad made from a continuous phase matrix material (e.g., polyurethane), or it may be an abrasive polishing pad made from abrasive particles fixedly dispersed in a suspension medium. The planarizing liquid 44 may be a conventional CMP slurry with abrasive particles and chemicals that remove material from the wafer, or the planarizing liquid 44 may be a planarizing solution without abrasive particles. In most CMP applications, conventional CMP slurries are used on conventional polishing pads, but planarizing solutions without abrasive particles are used on abrasive polishing pads.

The CMP machine 10 also has an under pad 25 attached to an upper surface 22 of the platen 20 and the lower surface of the polishing pad 40. A drive assembly 26 rotates the platen 20 (as indicated by arrow A), or it reciprocates the platen back and forth (as indicated by arrow B). Since the polishing pad 40 is attached to the under pad 25, the polishing pad 40 moves with the platen 20.

The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier; or an actuator assembly 36 may be attached to the wafer carrier 30 to impart axial and/or rotational motion (indicated by arrow C and arrow D, respectively).

To planarize the wafer 12 with the CMP machine 10, the wafer carrier 30 presses the wafer 12 face-downward against the polishing pad 40, and at least one of the platen 20 or the wafer carrier 30 moves relative to the other to move the wafer 12 across the planarizing surface 42. As the face of the wafer 12 moves across the planarizing surface 42, the polishing pad 40 and/or planarizing solution 44 continually remove material from the face of the wafer 12.

CMP processes must consistently and accurately produce a uniform planar surface on the wafer to enable precise circuit and device patterns to be formed with photolithography techniques. As the density of integrated circuits increases, it is often necessary to accurately focus the critical dimensions of the photo-patterns to within a tolerance of approximately 0.1 $\mu$m. Focusing photo patterns to such small tolerances, however, is difficult when the planarized surface of the wafer is not uniformly planar. Thus, CMP processes must create a highly uniform planar surface.

One problem with the CMP processes is that the surface of the wafer may not be uniformly planar because the rate at which the thickness of the wafer decreases (the "polishing rate") may vary from one area of the wafer to another. The polishing rate depends, in part, on the relative linear velocity between the surface of the wafer and the portion of the planarizing surface contacting the wafer. The linear velocity of the planarizing surface of a circular, rotating polishing pad varies across the planarizing surface of the pad in proportion to the radial distance from the center of the pad. Similarly, the linear velocity also varies across the front face of the wafer in proportion to the radial distance from the center of the wafer. The variation of linear velocities across the face of the wafer and planarizing surface of the polishing pad creates a relative velocity gradient between the wafer and the polishing pad. In general, the relative velocity gradient between the wafer and the pad causes the polishing rate to vary across the face of the wafer in a center-to-edge profile where the perimeter of the wafer polishes faster than the center of the wafer.

Several devices and concepts have been developed to reduce the center-to-edge planarizing profile across wafers. For example, U.S. Pat. No. 5,020,283 to Tuttle discloses a non-abrasive polishing pad with voids in the surface of the pad. The area of the planarizing surface occupied by the voids increases with increasing radial distance to reduce the contact area between the wafer and an abrasive slurry on the surface of the polishing pad towards the perimeter of the pad. Thus, at the periphery of the pad where the linear velocity of the pad is high, the voids reduce the polishing rate of the wafer compared to a planarizing surface without voids.

Although the non-abrasive polishing pad of U.S. Pat. No. 5,020,283 reduces the nonuniformity in polishing rates across a wafer, it may not provide adequate control of the polishing rate to produce a uniformly planar surface on the wafer. The pad of U.S. Pat. No. 5,020,283 seeks to control the polishing rate across the wafer by reducing contact area between the wafer and the slurry at selected areas on the pad. However, the distribution of the slurry between the wafer and the pad may not be uniform under the wafer because the perimeter of the wafer wipes the slurry off the planarizing surface leaving less slurry under the center of the wafer. Thus, even though existing devices control the contact area between the wafer and the pad at selected regions of the pad, they may not effectively control the polishing rate across the face of the wafer.

SUMMARY OF THE INVENTION

The present invention is an abrasive polishing pad for uniformly planarizing a semiconductor wafer or other substrate. In one embodiment, the abrasive polishing pad has a planarizing surface with a first planarizing region and a second planarizing region. The first planarizing region has a first abrasiveness and the second planarizing region has a second abrasiveness different than the first abrasiveness of the first region. The polishing pad preferably has a plurality of abrasive elements at the planarizing surface in at least one of the first or second planarizing regions. The abrasive elements may be abrasive particles fixedly suspended in a suspension medium, contact/non-contact regions on the pad, or other elements that mechanically remove material from the wafer. In the operation of a preferred embodiment, the lesser abrasive of the first and second planarizing regions contacts a first area of the wafer where the relative velocity between the wafer and the polishing pad is relatively high, and the more abrasive of the first and second planarizing regions contacts a second area of the wafer where the relative velocity between the wafer and the polishing pad is relatively low. The different abrasivenesses of the first and second planarizing regions compensate for variations in relative velocities across the face of the wafer to more uniformly planarize the wafer.

To control the abrasiveness of the first and planarizing second regions, several embodiments of abrasive polishing pads in accordance with the invention vary a characteristic of the abrasive elements in the first and second planarizing regions. In one embodiment, for example, the first region may have a higher number of abrasive elements per unit of surface area on the planarizing surface than the second region. In another embodiment, the first region may have abrasive elements with a size or shape that is more abrasive than that of the abrasive elements in the second region. In still another embodiment, the first region may have abrasive particles made from one material and the second region may have abrasive particles made from a different, less abrasive material.

DETAILED DESCRIPTION OF THE INVENTION

The present invention is an abrasive polishing pad for planarizing semiconductor wafers, baseplates for field emission displays, and other related substrates. An aspect of an embodiment of the invention is that the polishing pad has abrasive planarizing regions in which a first region has an abrasiveness sufficient to remove material from a wafer and a second region has an abrasiveness different than that of the first region. Another aspect of an embodiment of the invention is that the polishing pad has abrasive elements fixedly positioned in the first and second regions to control the abrasiveness of the pad under selected sections of the wafer. Thus, unlike conventional nonabrasive pads with an abrasive slurry, the abrasiveness acting against specific sections of the wafer may be effectively controlled to increase the uniformity of the polishing rate across the wafer. FIGS. 2–11, in which like reference numbers refer to like parts, illustrate various embodiments of planarizing machines and polishing pads in accordance with the invention.

Figure 1:
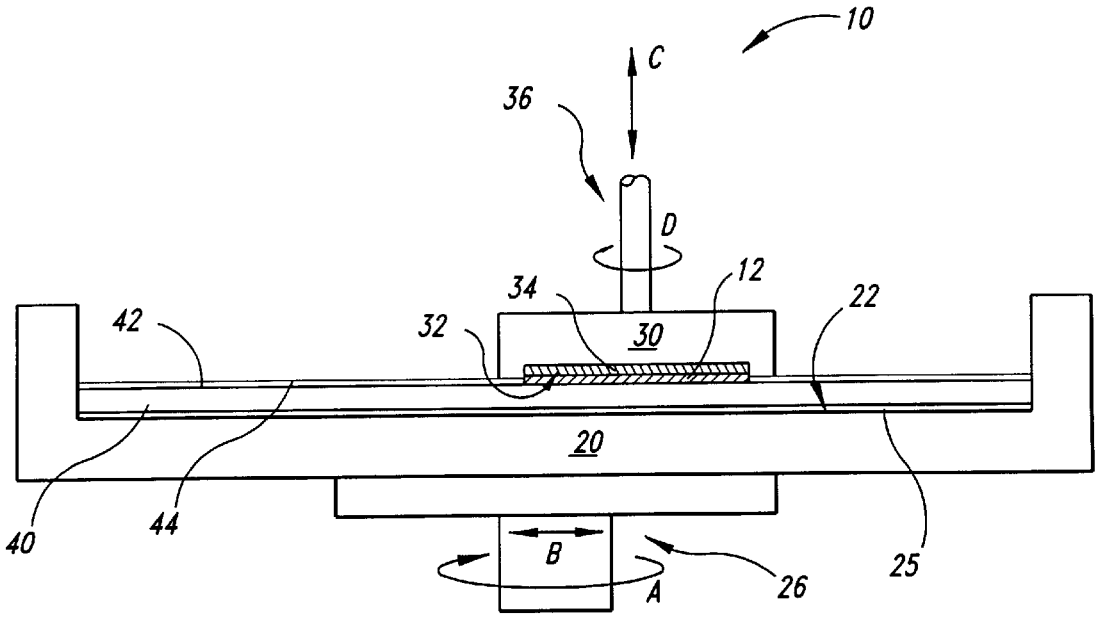
Fig. 1 (Prior Art)
FIG. 1 is a schematic cross-sectional view of a planarizing machine for planarizing a semiconductor wafer in accordance with the prior art.
Figure 2:
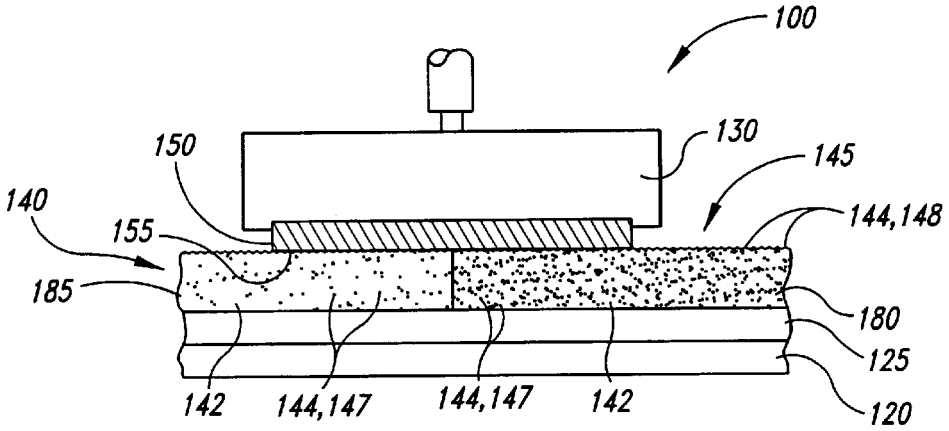
FIG. 2 is a partial schematic cross-sectional view of an embodiment of a planarizing machine and a polishing pad in accordance with the invention.
Figure 3:
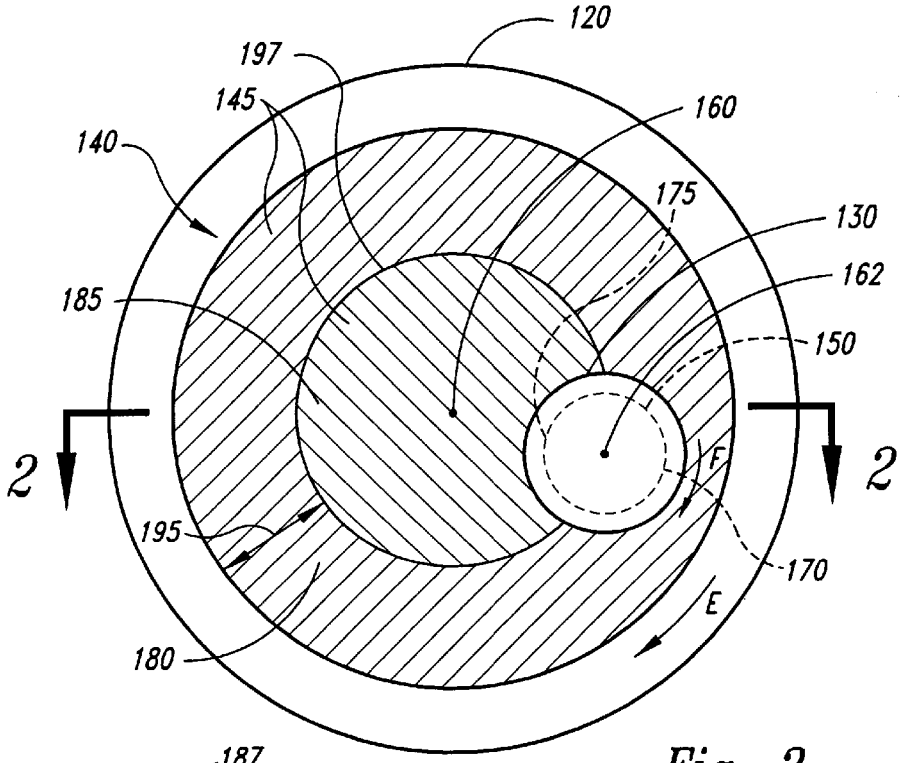
FIG. 3 is a schematic plan view of the planarizing machine and the polishing pad of FIG. 2.

FIG. 2 is a partial schematic cross-sectional view and FIG. 3 is a schematic plan view that illustrate an embodiment of a planarizing machine 100 with an abrasive polishing pad 140 in accordance with the invention. The planarizing machine 100 has a platen 120, an under pad 125 attached to the platen 120, and a wafer carrier 130 positioned over the platen 120. The abrasive polishing pad 140 is attached to the under pad 125. The abrasive polishing pad 140 has a planarizing surface 145, a first abrasive region 180 with a first abrasiveness capable of removing material from a wafer 150, and a second abrasive region 185 with a second abrasiveness different than the first abrasiveness of the first region 180.

The abrasive polishing pad 140 is preferably a body made from a matrix material 142 and a plurality of abrasive elements 144. The abrasive elements 144 are preferably formed from or distributed within the matrix material 142, and they are capable of removing material from a lower surface 155 of the wafer 150. In general, the abrasive elements 144 are preferably abrasive particles 147 fixedly distributed within the matrix material 142, contact regions 148 formed from the matrix material 142, a combination of abrasive particles 147 and contact regions 148, or other fixed mechanical features on the planarizing surface 145 capable of removing material from the wafer 150. As discussed in greater detail below, the abrasiveness of the first and second regions 180 and 185 is controlled by the size, shape, distribution and composition of the abrasive elements 144.

FIG. 3 further illustrates an embodiment of the operation of a circular abrasive polishing pad 140 in which the first abrasive region 180 is more abrasive than the second abrasive region 185. The polishing pad 140 rotates clockwise (indicated by arrow E) about a polishing pad axis 160, and the wafer 150 rotates clockwise (indicated by arrow F) about a wafer axis 162. Depending on the radii and angular velocities of the pad 140 and the wafer 150, the relative velocity between the pad 140 and the wafer 150 is generally less at an outer point 170 of the wafer 150 than it is at an inner point 175 because the wafer 150 and the polishing pad 140 rotate in the same direction. To compensate for the low relative velocity at the outer point 170 of the wafer 150, the more abrasive first region 180 is positioned radially outwardly from the less abrasive second region 185. Additionally, the wafer carrier 130 presses the wafer 150 against the polishing pad 140 to position areas on the wafer 150 with a low relative velocity over the more abrasive first region 180 and areas on the wafer 150 with a high relative velocity over the less abrasive second region 185. As a result, the more abrasive first region 180 increases the polishing rate at areas on the wafer where the relative velocity is low, and the less abrasive second region 185 reduces the polishing rate at areas on the wafer 150 where the relative velocity is high. Thus, even though the relative velocity between the pad 140 and the wafer 150 varies across the face of the wafer 150, the polishing pad 140 provides a surface with fixed abrasive regions upon which the wafer 150 may be selectively positioned to more uniformly polish the surface of the wafer.

An advantage of an embodiment of the polishing pad 140 is that it compensates for the non-uniform relative velocity between the polishing pad 140 and the wafer 150. Unlike conventional non-abrasive polishing pads that use an abrasive slurry, the distribution of the abrasive elements 144 under the wafer 150 may be accurately controlled because the abrasive elements 144 are fixed with respect to the planarizing surface 145 of the polishing pad 140. Additionally, unlike conventional non-abrasive or abrasive polishing pads, the abrasiveness across the planarizing surface 145 of the polishing pad 140 is varied to provide high abrasive regions under low relative velocity areas on the wafer and low abrasive regions under high relative velocity areas on the wafer. As a result, the polishing rate of the high relative velocity areas on the wafer is reduced, while the polishing rate of low relative velocity areas on the wafer is increased. The preferred embodiment of the polishing pad 140, therefore, enhances the uniformity of the planarized surface of the wafer 150.

In addition to the circular polishing pad 140 and wafer 150 that rotate clockwise (illustrated in FIG. 3), the polishing pad 140 may have different shapes and both the pad 140 and the wafer 150 may move in any direction that creates relative motion between the pad 140 and the wafer 150. To produce the relative motion between the pad 140 and the wafer 150, the polishing pad 140 and/or the wafer 155 may translate and/or rotate with respect to one another. In accordance with an embodiment of the invention, the more abrasive of the first and second regions 180 and 185 is positioned to engage the low relative velocity areas on the wafer 150, and the less abrasive of the first and second regions 180 and 185 is positioned to engage the high relative velocity areas on the wafer 150.

Figure 4:
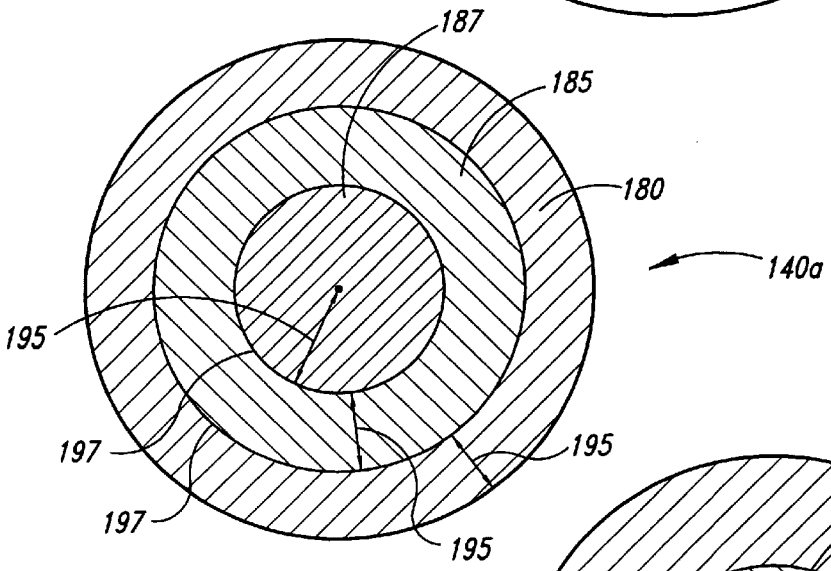
FIG. 4 is a schematic plan view of another embodiment of a polishing pad in accordance with the invention.

FIG. 4 is a schematic plan view of another embodiment of an abrasive polishing pad 140(*a*) that has a first abrasive region 180 with a first abrasiveness, a second abrasive region 185 with a second abrasiveness, and a third abrasive region 187 with a third abrasiveness. In a preferred embodiment, the first abrasiveness of the first region 180 is greater than the second abrasiveness of the second region 185, and the second abrasiveness of the second region 185 is greater than a third abrasiveness of the third region 187. The polishing pad 140(*a*) closely tailors the abrasiveness of the planarizing surface to the relative velocities between the polishing pad 140 and the wafer 150. It will be appreciated that the present invention includes additional embodiments with more than three abrasive regions to further tailor the abrasiveness of the planarizing surface to the relative velocity gradient between the polishing pad 140 and the wafer 150.

Referring to FIGS. 3 and 4 together, the abrasiveness of a given region is preferably constant throughout the region to provide sharp demarcation boundaries 197 between areas of different abrasiveness on the planarizing surface 145 of the pads. Alternatively, the abrasiveness across a width 195 of a region may vary so that the abrasiveness gradually changes from one region to another across the planarizing surface 145

Figure 5:
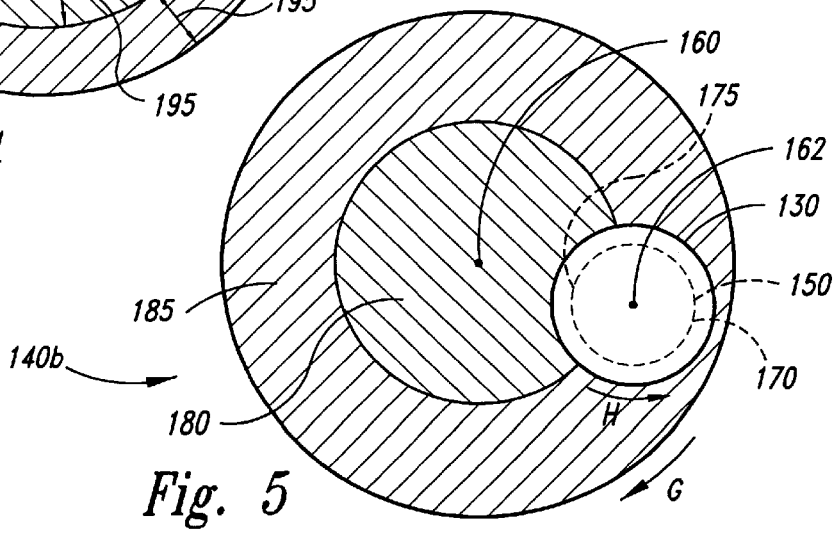
FIG. 5 is a schematic plan view of another embodiment of a polishing pad in accordance with the invention.

FIG. 5 is a schematic view of another embodiment of a polishing pad 140(*b*) in which the polishing pad 140(*b*) and the wafer carrier 130 rotate in opposite directions (indicated by arrows G and H). The relative velocity between the polishing pad 140(*b*) and the wafer 150 is accordingly greater at the outer point 170 of the wafer 150 than at the inner point 175. Therefore, in the embodiment shown in FIG. 5, the more abrasive first region 180 is positioned to engage the inner point 175 and the less abrasive second region 185 is positioned to engage the outer point 170.

FIGS. 6–10 are partial schematic cross-sectional views that illustrate additional embodiments of polishing pads 140 in which the first and second abrasive regions 180 and 185 have different abrasivenesses. The abrasiveness of the first and second regions 180 and 185 is preferably controlled by altering the characteristics of the abrasive elements 144 from one region to another. Accordingly, since the abrasive elements 144 are fixed with respect to the pad 140, the abrasiveness of the planarizing surface 145 is a static characteristic of the polishing pads 140 that is not altered by the wafer during planarization.

Figure 6:
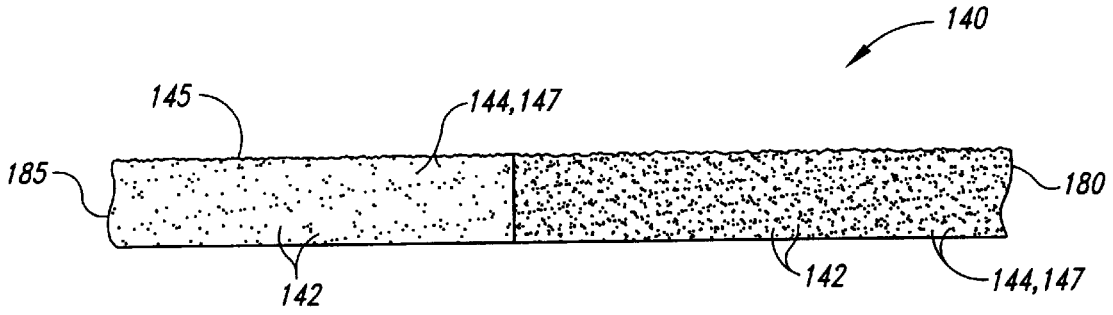
FIG. 6 is a partial schematic cross-sectional view of another embodiment of a polishing pad in accordance with the invention.

FIG. 6 illustrates an embodiment of the polishing pad 140 in which the abrasive elements 144 are abrasive particles 147 fixedly dispersed in the matrix material 142. Additionally, the first abrasive region 180 has a greater number of abrasive particle 147 per unit area at the planarizing surface 145 than the second abrasive region 185. The first abrasive region 180 is accordingly more abrasive than the second abrasive region 185. The abrasive particles 147 preferably occupy between 50% and 99% of the planarizing surface 145 in the first abrasive region 180, and more preferably between 60% and 80%. Suitable abrasive particles include silicon dioxide, cerium oxide, aluminum oxide and tantalum oxide particles.

In another embodiment of the invention (not shown), the abrasiveness of each region of the polishing pad 140 is controlled by varying the chemical composition of the abrasive particles from one region on the pad to another. For example, highly abrasive cerium oxide particles may be dispersed in the first abrasive region 180 and lesser abrasive silicon dioxide particles may be dispersed in the second abrasive region 185. Other embodiments of polishing pads may disperse intermediately abrasive aluminum oxide or tantalum oxide particles to add a third abrasive region or alter the abrasiveness of the first or second abrasive regions 180 and 185. In still other embodiments, the abrasiveness of a region may be controlled by a combination of particle density and particle composition. Referring again to FIG. 6, for example, the abrasive particles 147 in the first abrasive region 180 may be cerium oxide particles and the abrasive particles 147 in the second abrasive region 185 may be silicon dioxide particles.

Figure 7:
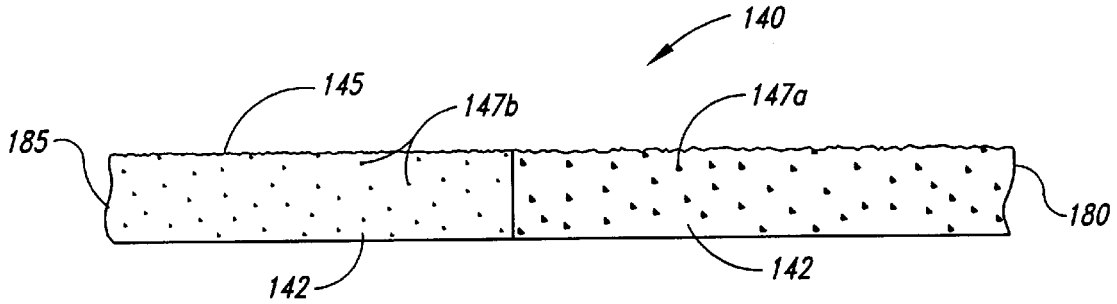
FIG. 7 is a partial schematic cross-sectional view of another embodiment of a polishing pad in accordance with the invention.

FIG. 7 illustrates another embodiment of the polishing pad 140 in which the abrasiveness of the first and second regions 180 and 185 is controlled by the particle size of the abrasive particles 147. The first abrasive region 180 preferably has large abrasive particles 147(*a*) and the second abrasive region 185 preferably has small abrasive particles 147(*b*). The first abrasive region 180 with the large abrasive particles 147(*a*) is accordingly more abrasive than the second region 185 with the smaller abrasive particles 147(*b*). The abrasive particles 147(*a*) and 147(*b*) are preferably between 0.015 $\mu$m and 1.5 $\mu$m in cross section, and more preferably less than 1.0 $\mu$m in cross section.

Figure 8:
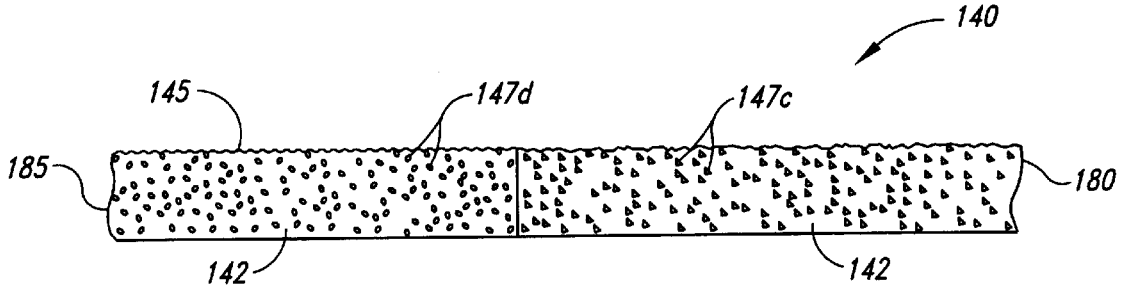
FIG. 8 is a partial schematic cross-sectional view of another embodiment of a polishing pad in accordance with the invention.

FIG. 8 illustrates another embodiment of the polishing pad 140 in which the abrasiveness of the first and second regions 180 and 185 is controlled by the external shape of the particles. The first abrasive region 180 preferably has relatively rough abrasive particles 147(*c*) while the second abrasive region 185 preferably has smoother abrasive particles 147(*d*). For example, the rough abrasive particles 147(*c*) in the first abrasive region 180 may have sharp edges or other sharp projections. In contrast, the smoother abrasive particles 147(*d*) in the second abrasive region 185 may be slightly less angular or have other shapes that are less abrasive than the rough abrasive particles 147(*c*).

Figure 9:
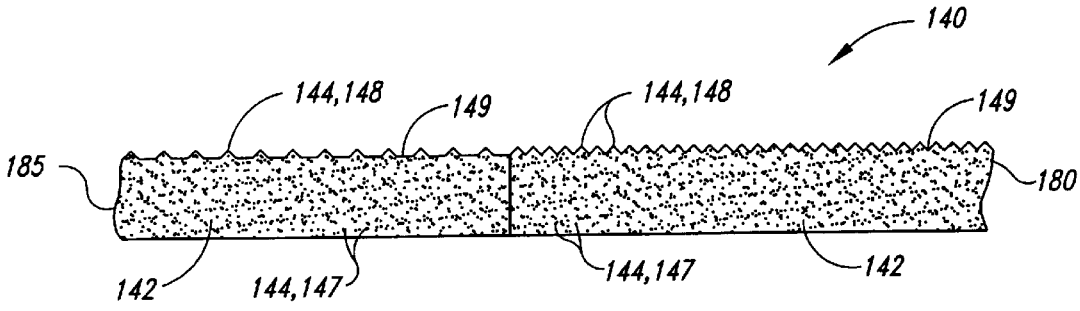
FIG. 9 is a partial schematic cross-sectional view of another embodiment of a polishing pad in accordance with the invention.

FIG. 9 illustrates another embodiment of the polishing pad 140 in which the abrasive elements 144 are contact regions 148 formed from the matrix material 142 and defined by the polishing pad face, and separated from each other by non-contact regions 149 defined by voids in the face. The abrasive elements 144 may be a combination of the contact regions 148 and the abrasive particles 147 such that the abrasive contact regions 148 abrade the surface of a wafer (not shown) without abrasive slurries. Suitable patterns of contact regions 148 and non-contact regions 149 to vary the residence time of the wafer on the abrasive contact regions 148 are disclosed in U.S. Pat. No. 5,020,283, which is herein incorporated by reference. However, other patterns of contact regions 148 and non-contact regions 149 may also be used to vary the abrasiveness of the polishing pad 140. To vary the abrasiveness from the first region 180 to the second region 185, the first abrasive region 180 preferably has a different density of contact regions 148 than the second abrasive region 185. In an alternative embodiment (not shown), the shape of the abrasive regions 148 in the first region 180 may be different than the shape of the abrasive regions 148 in the second region 185.

Figure 10:
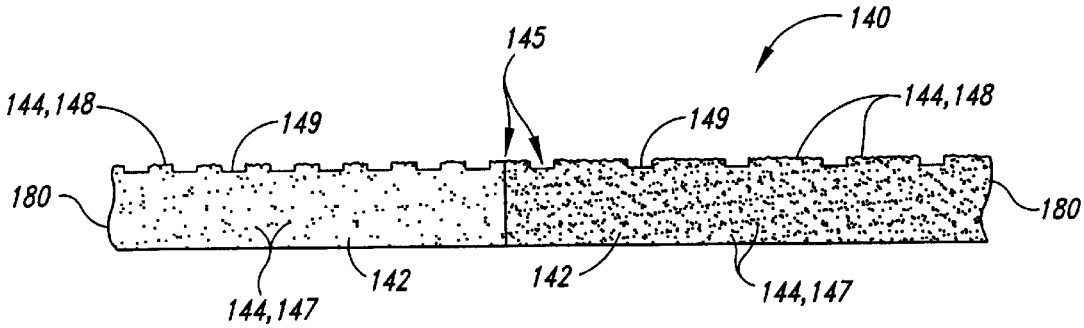
FIG. 10 is a partial schematic cross-sectional view of another embodiment of a polishing pad in accordance with the invention.

FIG. 10 illustrates another embodiment of the polishing pad 140 in which the abrasive elements 144 are both abrasive particles 147 and contact regions 148. The first abrasive region 180 preferably has a greater number of abrasive particles 147 per unit surface area than the second abrasive region 185. Additionally, the first abrasive region 180 also preferably has larger contact regions 148 than the second abrasive region 185 to increase the contact area between the wafer 155 and the planarizing surface 145 in the first abrasive region 180. Accordingly, the first abrasive region 180 of the polishing pad 140 illustrated in FIG. 10 has a much higher abrasiveness than the second abrasive region 185.

From the foregoing it will be appreciated that although specific embodiments of the invention have been described herein for purposes of illustration, various modifications may be made without deviating from the spirit and scope of the invention. Accordingly, the invention is not limited except as by the appended claims.

What is claimed is:

1. In the manufacturing of electronic devices with integrated circuits, a method for planarizing a substrate with microelectronic components, comprising:

continuously pressing the substrate against a first abrasive region of an abrasive polishing pad and a second abrasive region of the abrasive polishing pad contemporaneously, the first abrasive region having a first abrasiveness and the second abrasive region having a second abrasiveness different than the first abrasiveness; and moving at least one of the polishing pad and the substrate with respect to the other to impart relative motion therebetween and intermittently contacting areas on the substrate with the first and second abrasive regions, wherein the polishing pad is circular, the first planarizing region is positioned radially outwardly from the second planarizing region, the first abrasiveness is greater than the second abrasiveness, and at least one of the polishing pad and the substrate rotates to create a relative velocity gradient between the substrate and the polishing pad having a first relative velocity zone and a second relative velocity zone with a greater relative velocity than the first relative velocity zone, and wherein the pressing step comprises positioning the substrate against the polishing pad to locate the first relative velocity zone over the first planarizing region and the second relative velocity zone over the second planarizing region.

2. The method of claim 1 wherein the moving step comprises rotating the substrate and the polishing pad.

* * * * *